United States Patent [19]

Hanson

[11] Patent Number: 4,785,560

[45] Date of Patent: Nov. 22, 1988

[54] CONTINUOUS EXCAVATING APPARATUS

[75] Inventor: Raymond A. Hanson, Spokane, Wash.

[73] Assignee: R. A. Hanson Company, Inc., Spokane, Wash.

[21] Appl. No.: 4,338

[22] Filed: Jan. 16, 1987

[51] Int. Cl.[4] ..... E02F 3/24

[52] U.S. Cl. ..... 37/190; 37/96; 37/191 A; 37/192 A; 299/67; 299/76

[58] Field of Search ..... 37/96, 189, 190, 89, 37/94, 192 R, 87, 191 R, 191 A, 192 A; 299/64, 67, 76

[56] References Cited

U.S. PATENT DOCUMENTS

| | | | |
|---|---|---|---|
| 1,424,093 | 7/1922 | Gilman | 37/189 X |
| 2,834,127 | 5/1958 | Kolbe | 37/189 |
| 3,091,874 | 6/1963 | Wuigk | 37/190 |
| 3,258,865 | 7/1966 | Andorf | 37/190 |
| 3,298,117 | 1/1967 | Pelzer et al. | 37/190 |
| 3,452,461 | 7/1969 | Hanson | 37/190 X |
| 3,690,023 | 9/1972 | Peterson | 37/190 X |
| 3,841,006 | 10/1974 | Mironov et al. | 37/189 X |
| 3,896,571 | 7/1975 | Satterwhite | 37/190 |
| 3,962,803 | 6/1976 | O'Brien | 37/189 X |
| 3,966,258 | 6/1976 | Dolecki | 299/76 |
| 4,003,148 | 1/1977 | Satterwhite | 37/190 |
| 4,157,623 | 6/1979 | Satterwhite | 37/190 |

*Primary Examiner*—Edgar S. Burr
*Assistant Examiner*—Moshe I. Cohen
*Attorney, Agent, or Firm*—Wells, St. John & Roberts

[57] ABSTRACT

An excavating apparatus for breaking and removing material away from an upright face of material is disclosed. The apparatus includes a rotary cutting head mounted between the fore ends of a pair of boom arms. The boom arms are pivotally mounted relative to the front end of a vehicular portion of the apparatus. A shroud partially surrounds the cutting head for confining material cut from the face. The shroud includes an edge shoe portion for engaging the face and is pivotally mounted at the fore-end of the boom arms. The shroud is adapted for selective rearward pivotal movement as the boom arms are swung upwardly for maintaining the edge shoe portion against the face.

23 Claims, 7 Drawing Sheets

13
58
64
14
62
56
60
50
52
22
70
24
52
22
70
24
52
22
70
C
B
A

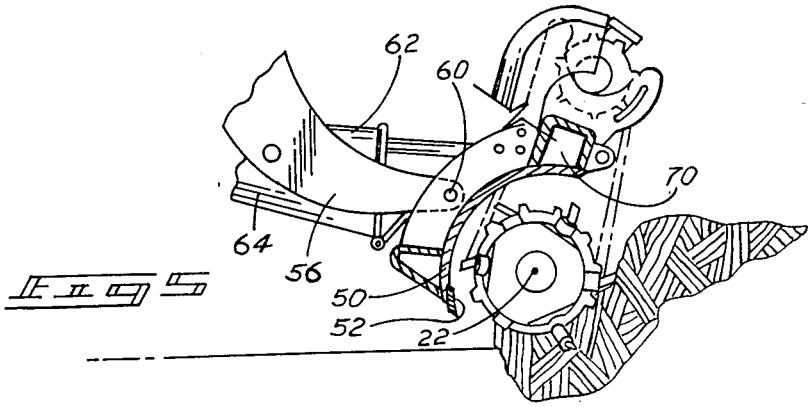
Fig 5
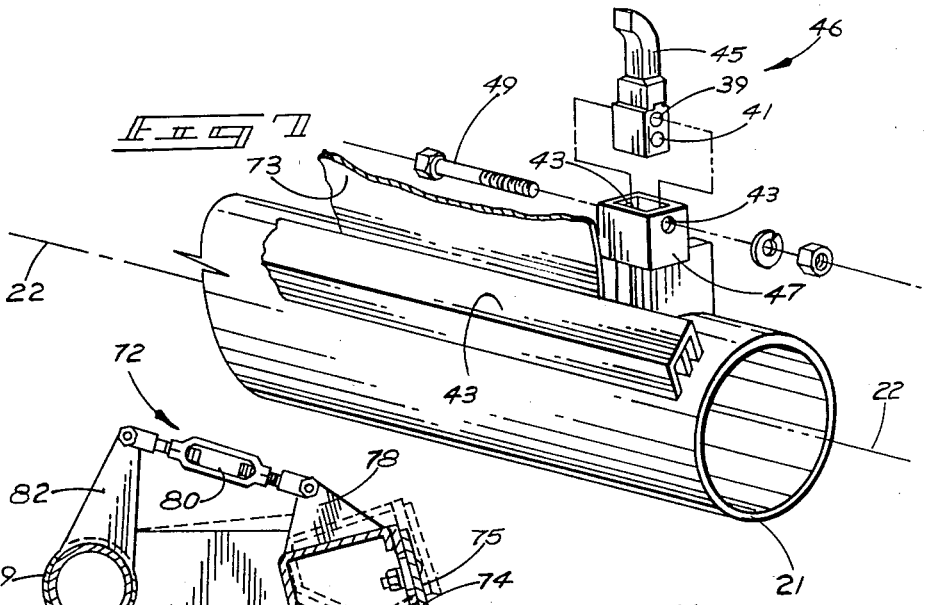
Fig 7
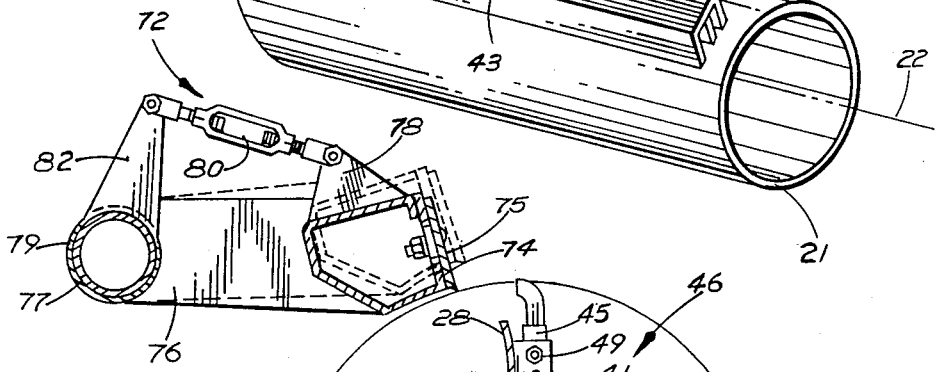
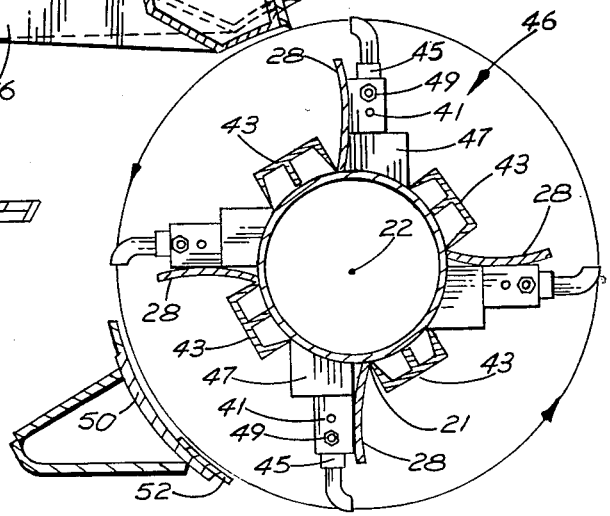
Fig 9

CONTINUOUS EXCAVATING APPARATUS

TECHNICAL FIELD

This invention relates generally to excavators, and more particularly to excavators usable for breaking and removing material away from an upright face of material.

BACKGROUND OF THE INVENTION

The invention arose out of needs and concerns relating to open pit coal mining. Open pit mining commonly is performed using a combination of drilling and blasting techniques, and excavating machinery to remove material from the open pit. Excavating machinery is commonly used to break material away from a generally upright face of material for its subsequent removal from the mining pit. Such machinery can include a horizontally mounted, open cutter head having peripheral cutter elements such as teeth or buckets for breaking material from the face.

Presently accepted machinery has many drawbacks. For example, some excavating machinery is mounted on three or four track crawlers, requiring an inordinate amount of open pit area for maneuvering. Also, a number of excavators use bucket wheel cutting heads for breaking material from a face. These excavators rough cut a face of material, resulting in a significant loss of product from the face and requiring separate clean-up machines. Other excavators utilize open cutting heads also enabling the cuttings from the face to fall freely towards the floor of the pit for collection by separate equipment or a gathering arm and conveyor system. Such gathering systems require a large amount of maintenance. Additionally, material falling from the face generates an excessive amount of fumes and dust.

Accordingly, a need remains for improved excavating machinery which is capable of removing material from a tall face, minimizes dust generation, crushes material to a desirable level and transfers the material to separate removal equipment with a minimal degree of handling.

BRIEF DESCRIPTION OF THE DRAWINGS

Preferred embodiments of the invention are illustrated in the accompanying drawings, in which:

FIG. 6 is an enlarged front perspective view of a rotary cutting head assembly used with the excavating apparatus of FIG. 1;

FIG. 8 is an overhead view of an alternate embodiment cutting head assembly in accordance with the invention utilizing an adjustable breaker bar for sizing of material;

FIG. 9 is a fragmentary section view taken along line 9—9 in FIG. 8.

DETAILED DESCRIPTION OF THE PREFERRED EMBODIMENT

Figure 1:
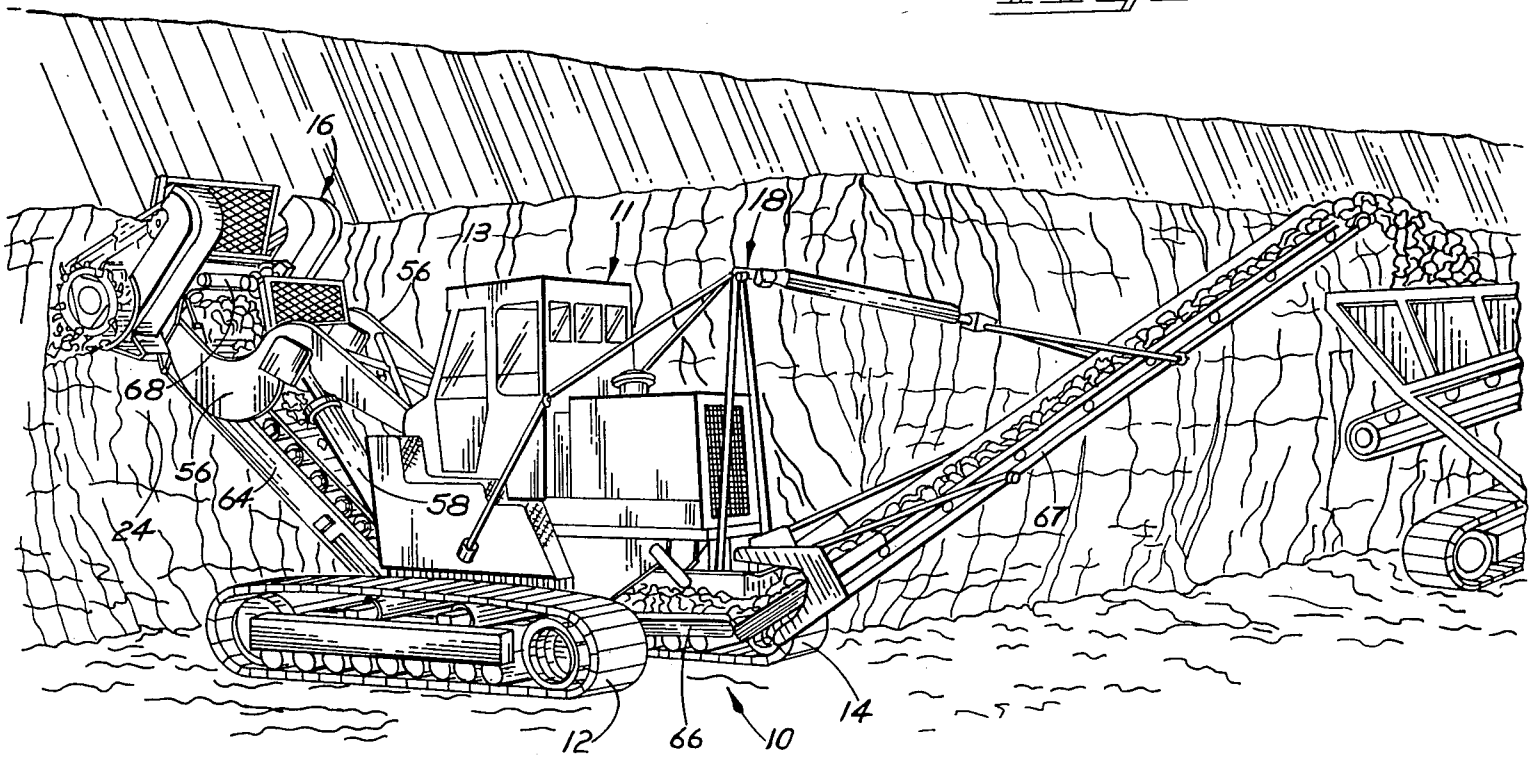
FIG. 1 is a perspective view of an excavating apparatus in accordance with the invention shown mining a generally upright face of material within an open pit mine.

The following disclosure of the invention is submitted in compliance with the constitutional purpose of the Patent Laws "to promote the progress of science and useful arts" (Article 1, Section 8).

Referring to the drawings, an excavating apparatus in accordance with the invention is indicated generally by reference numeral 10. Excavating apparatus 10 includes a central vehicular portion 11 having an opposing pair of driven track crawlers 12, 14 for moving apparatus 10 over the surface of the open mine pit. Central portion 11 includes an operator's cab 13 and associated engines and other machinery for driving tracks 12, 14, and other operative machinery which will be more fully described below. A cutting head assembly 16 is mounted to one transverse end (fore end) of central portion 11 and is adapted for breaking and removing material away from a generally upright face of material 24. Mounted to the rear (aft) of central portion 11 is a pivotal and vertically adjustable boom member 18 which operably supports a moving conveyor 67 for transferring material broken by cutting head assembly 16 from apparatus 10.

Figure 2:
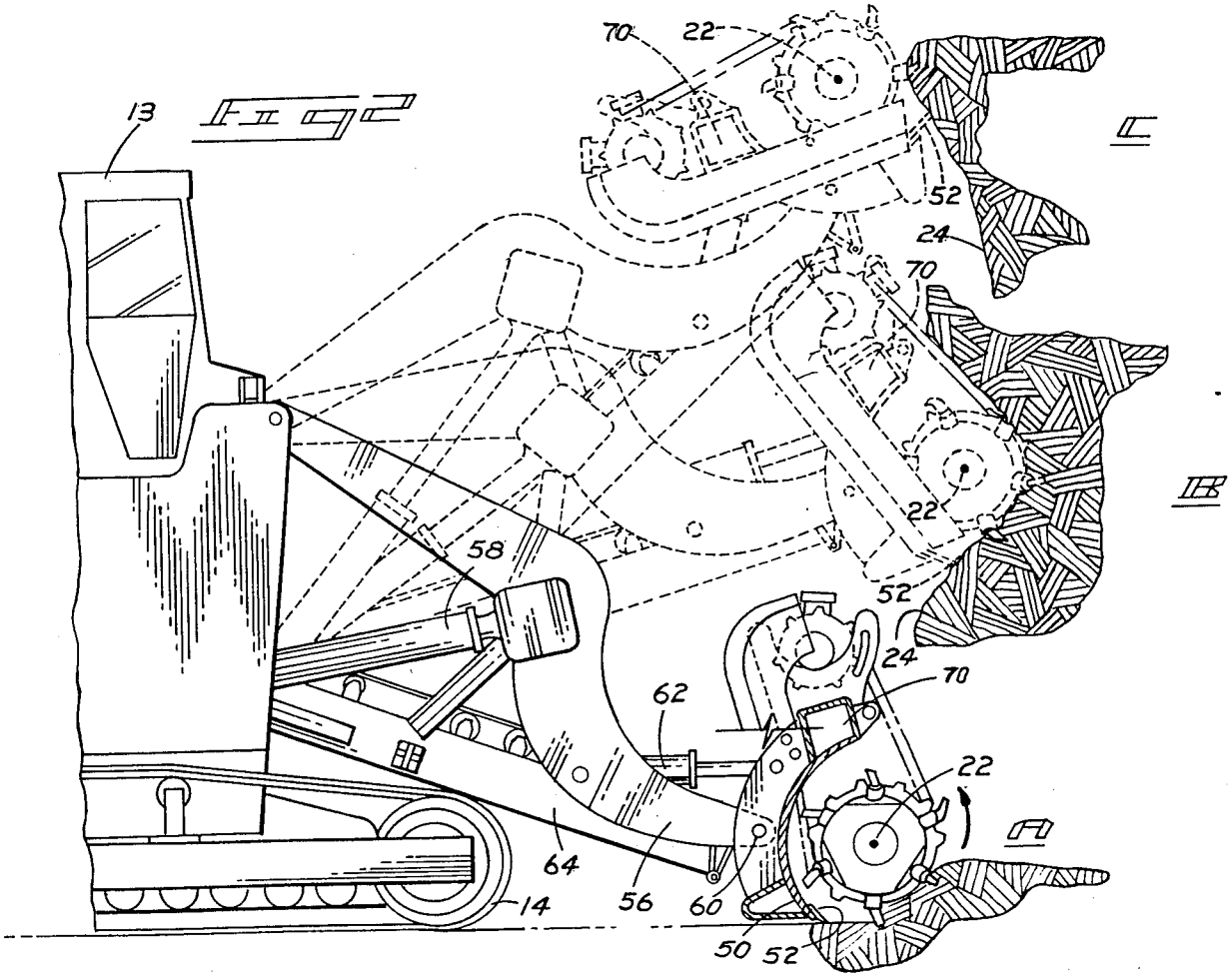
FIG. 2 is a fragmentary side view of the fore end of the excavating apparatus of FIG. 1 with different operative mining positions being shown in phantom.
Figure 3:
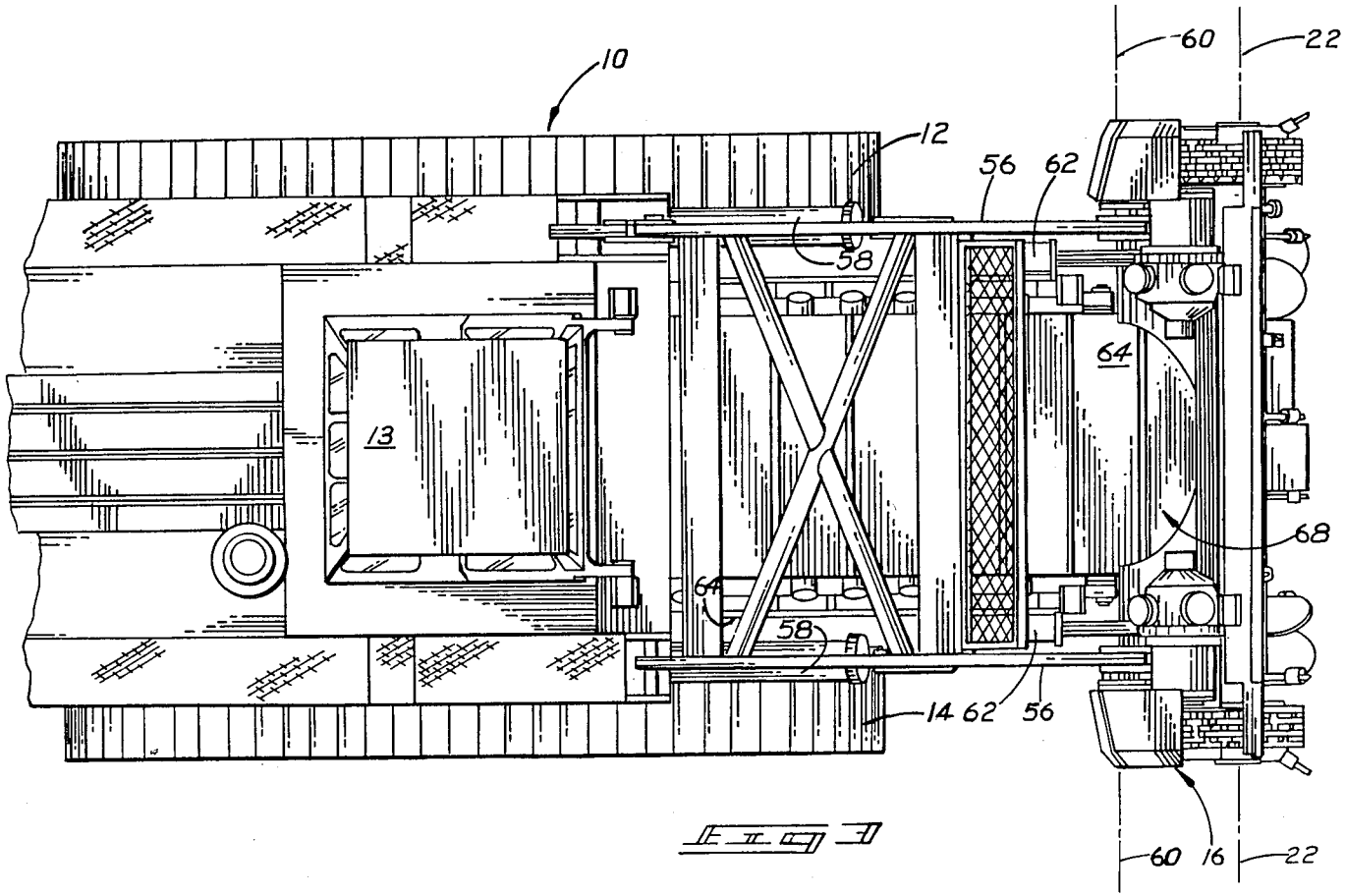
FIG. 3 is a top view of the excavating apparatus of FIG. 1.
Figure 7:
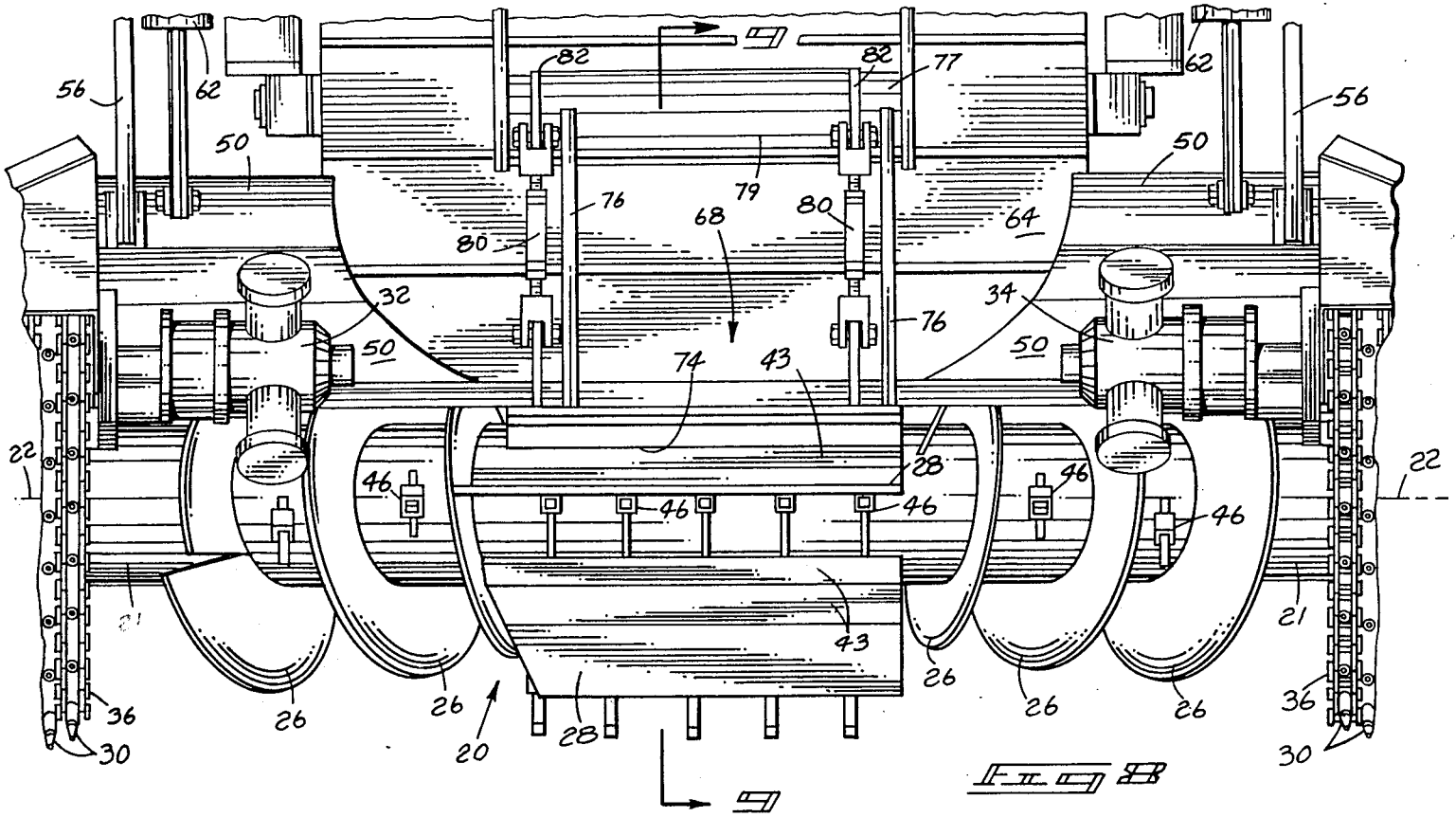
FIG. 7 is an enlarged, partially exploded, perspective view of a portion of the cutting head of FIG. 6.

Referring more particularly to FIGS. 2, 6, and 7, cutting head assembly 16 includes a rotary cutting head 20 mounted for rotation about its longitudinal axis 22. Axis 22 is laterally oriented with respect to the overall elongate configuration of apparatus 10. Cutting head 20 includes a central steel tube or core 21 having support or stub shafts 23 welded at its ends. A series of radially directed continuous vanes 26 are secured to the exterior surface of tube 21 by welding or bolting. Each of vanes 26 spiral inwardly in opposite directions from the outer ends of tube 21 toward the longitudinal center of cutting head 20. The central or innermost end of each vane 26 is connected to an end of a plate 28. Plates 28 are secured by welding to the surface of tube 21 and extend radially from the central portion of core 21. Each is angled slightly relative to longitudinal axis 22.

A plurality of cutting teeth assemblies 46 are secured to core 21 and extend radially outward adjacent vanes 26 and plates 28, preferably at equal intervals. Cutting teeth assemblies 46 define the outermost periphery of cutting head 20. Cutting assemblies 46 are adapted for breaking material from a face as cutting head 20 is caused to rotate. The reverse spiraling orientation of vanes 26 causes removed material to flow toward the center of cutting head 20 and plates 28. Plates 28 form a cutting head central bucket portion for collecting material for transferring to a conveyor system as will be more fully described below.

As shown in FIG. 7, each of cutter assemblies 46 includes a carbide cutter element or tooth member 45, a generally hollow tooth holder 47, and a locking nut and bolt assembly 49. Tooth holder 47 is secured to core 21 preferably by welding and includes a pair of axially aligned holes 43 extending transversely through its sidewalls. Cutting element 45 is sized to be received within tooth holder 47 and includes two transversely extending holes 39, 41 at its lower end. Holes 43 of tooth holder 47 are adapted to align with one of holes 39 or 41 of cutting element 45 for receiving locking bolt assembly 49 therethrough. The different positioned pair of holes 39, 41 in cutter element 45 enables the cutting element to be moved inwardly or outwardly relative to core 21 to enable the depth of cut obtainable with cutting head 20 to be varied.

A pair of double row roller support bearings, not readily viewable in the figures, support stub shafts 23 and core 21 for rotation about transverse axis 22. Heavy chain drive sprockets 42 are secured to the support bearings. Each of sprockets 42 is power driven by a pair of multi-rowed chains 36 for rotatably driving cutting head 20. A pair of hydraulic motors 32, 34 are mounted to framework above and at the end of rotary cutting head 20. Each motor 32, 34 powers a drive sprocket 44 for driving chains 36, sprockets 42 and correspondingly cutting head 20. A screen 39 is mounted to prevent broken material from falling to motors 32, 34.

Each of drive chains 36 further includes a plurality of outwardly projecting cutting bits 30 for creating a path for chains 36 as cutting assembly 16 is caused to be advanced into a face of material. Cutting bits 30 of each opposing chain drive 36 are arranged in mirror image downwardly and outwardly angled patterns for causing material broken by bits 30 to be directed outwardly away from cutting head 20. The outermost ends of stub shafts 23 also include cutting elements in the form of fly cutters 48. Fly cutters 48 angle radially outward from shafts 23 for side cutting as cutting head 20 is caused to move longitudinally relative to its axis, as would occur when excavating apparatus 10 is caused to pivot to the right or left. A chain guard 51 covers the rear end of the chain drive.

Cutting head assembly 16 further preferably includes a shroud 50 which partially surrounds cutting head 20 and extends between first and second cutting head transverse ends. Shroud 50 is elevationally movable with cutting head 20 and serves as a receiving means for confining material broken by the cutting head. Shroud 50 includes a longitudinally extending shoe 52 connected along its lower longitudinal edge. Shoe 52 includes an outer longitudinal edge 54 extending along the length of cutting head 20 at a location adjacent the cutting periphery defined by the outermost extent of peripheral cutter teeth 45. As shown, shoe 52 and shroud 50 are separate or distinct members, the shoe 52 being connected along an outer longitudinal edge of the shroud. Alternatively, the shroud and shoe could be integrally formed. The construction of the shoe separate from the shroud enables the shoe to be replaced when damaged or after becoming excessively worn.

Shoe 52 is adapted for engaging and sealing an upright face of material being cut with respect to cutting head 20. As such, shoe 52 and shroud 50 serve to confine and prevent cuttings cut by cutting head 20 from falling to the floor of the open mine pit. Positioning means are provided for moving shoe 52 relative to cutting head axis 22 for selectively bringing outer longitudinal edge 54 of shoe 52 into sealing engaging relationship with upright face 24.

More particularly, excavating apparatus 10 includes a pair of fore-mounted elevationally moveable boom arms 56. Boom arms 56 are pivotally mounted at one end of the fore end of central or vehicle portion 11. Pivotal movement of boom arm 56 about the one end relative to central portion 11 is selectively controlled by an operator through a hydraulic piston and cylinder drive assemblies 58. Shroud 50 is pivotally mounted at its transverse ends to the opposite end of boom arms 56 for pivotal movement about a pivot axis 60. Pivot axis 60 and cutting head axis 22 are parallel to one another as shown. Hydraulically driven piston and cylinder assemblies 62 are also pivotally interconnected between shroud 50 and boom arms 56 to control pivotal movement about pivot axis 60. In the illustrated embodiment, cutting head assembly 16 can be tilted back approximately 60° enabling the relative longitudinal position of edge shoe portion 54 and cutting head axis 22 to be varied for locating shoe 52 against face 24. Accordingly, the pivotal connection of shroud 50 transversely relative to boom arms 56 serves as a positioning means for moving shoe 52 relative to cutting head axis 22 for selectively bringing outer longitudinal shoe edge 54 into sealing engaging relationship with an upright face of material. Boom arms 56 serve as an adjustment means for moving shoe 52 and cutting head 20 in unison elevationally relative to an upright face 24.

Cutting head assembly 16 also is provided with a breaker bar 71 formed along the upper edge of shroud 50. Breaker bar 71 is provided for the breaking of material as it is forced into the shroud region of the cutting head. It is positioned away from peripheral cutting teeth 46 at some predetermined radial distance relative to cutting head axis 22. Channel-like members 43 are also provided to aid in the sizing of the broken material. They are secured to tube 21 and extend radially outward therefrom along the central bucket portion of the cutting head. Material cut by the cutting elements is forced to the center of the head and forced to pass between the breaker bar and channel members 43 resulting in the cut material being predetermingly sized.

Referring to FIGS. 8 and 9, an alternate adjustable breaker bar assembly 72 is illustrated. The adjustability of breaker bar assembly 72 enables the predetermined size of material being cut to be varied. Breaker bar assembly 72 includes a support bar 74 which extends along the central bucket portion of cutting head 20. A removable face plate 75 is bolted to support bar 74. Face plate 75 is replaceable enabling it to be changed after damage or excessive wear. A pair of arms 76 extends rearwardly from the ends of support bar 74. The rearwardmost end of each arm 76 is connected to a rigid tube 77 extending the length of the central cutting portion of the cutting head. Tube 77 is rotatably received about a support tube 79 mounted to an upper portion of the shroud frame. A second pair of arms 78 extend upwardly from support bar 74. Arms 78 are longitudinally adjacent but slightly offset from rearwardly projecting arms 76. Arms 78 are longitudinally aligned with arms 82 which extend upwardly from support tube 79. A length adjustable turnbuckle 80 extends between and is connected to outer ends of each pair of aligned arms 78 and 82. This arrangement enables the position of support bar 74 relative to the peripheral cutting elements to be selectively varied for enabling the size of material removed by the cutter elements to be varied. Alternate means for mounting the support bar and varying its position are also possible as will be appreciated by the artisan.

Excavating apparatus 10 further includes a conveyor system for removing material broken by cutting head assembly 16 from apparatus 10. The conveyor system includes a heavy duty feed conveyor 64 mounted between boom arms 56 for receiving cuttings from rotary cutting head assembly 16. Feed conveyor 64 is pivotally mounted at its discharge end to a lower portion of central vehicular portion 11. The opposite receiving end of conveyor 64 is pivotally mounted between the outer ends of boom arms 56 adjacent the central rear portion of shroud 50. The central rearmost section of shroud 50 includes an aperture 68 having a width slightly narrower than the width of conveyor 64 for feeding material centrally directed by cutting head 20 to conveyor 64.

A transfer conveyor 66 (FIG. 1) extends beneath central vehicle portion 11 between track crawlers 12, 14 for carrying cuttings beneath vehicle portion 11 for subsequent discharge onto yet another conveyor 67. The discharge end of feed conveyor 64 overlaps the front receiving end of conveyor 66 for transferring material from conveyor 64 to conveyor 66. The feed and transfer conveyors are preferably flat, low profile conveyors with roller idler bearings, full length skirt boards and appropriate shielding to contain the material being transferred. Both are preferably hydraulically driven.

Conveyor 67 is a heavy duty troughed belt conveyor mounted to rear boom member 18 which is hinged and pivotally mounted at the rear end of vehicle portion 11. The discharge end of transfer conveyor 66 is aligned with the feed end of conveyor 67 for transferring material therebetween. The outermost end of conveyor 67 can be raised or lowered to a desired position for discharging material at elevations ranging from 5 to 25 feet above the working floor of the open mine pit. Other designs and sizing of components could also be used to provide different discharge elevations. The elevational adjustment capability allows minimizing of dust generated by free falling material. As shown, side to side pivotal movement of the outer end of conveyor 67 is available through approximately 150° for discharge of material either to the side or rear of excavating apparatus 10. The pivotal and elevational adjustment motions are preferably hydraulically powered, as is the belt of conveyor 67.

An operational sequence for cutting a face of material with excavating apparatus 10 will be described first with reference to FIG. 2. FIG. 2 illustrates operational movement of various components of excavating apparatus 10 as an upward cut is made in a face of material 24. To begin such an upward cut, the excavating apparatus 10 with cutting head assembly 16 lowered to the floor of the pit (as shown in position A) is caused to rotate counterclockwise. Excavating apparatus 10 is then crowded forward (transversely relative to face of material 24) by moving crawler tracks 12, 14 simultaneously to make an initial cut of approximately 18". Material cut by the various cutter teeth is confined by shroud 50 and caused to flow to the central bucket portion of cutting head 20 by spiraling vanes 26. Material is transferred through aperture 68 of shroud 50 to first conveyor 64 and then to subsequent conveyors 66 and 67 for subsequent removal from the pit. Cutting head 20 is then caused to be tilted back by pivoting about pivot axis 60, and the apparatus advanced forward (transversely relative to face of material 24) another 18", providing a penetration of 36". An up-cut is then made by engaging boom arms 56 to move upwardly while simultaneously pivoting cutter head 20 rearwardly (as shown in positions B and C) to keep the shoe in contact with face 24. This enables shroud 50 to contain the cuttings and prevent them from free falling to the floor of the pit. During this upward cutting movement, the apparatus 10 can be crowded forward an approximate additional 12" into the face.

Figure 4:
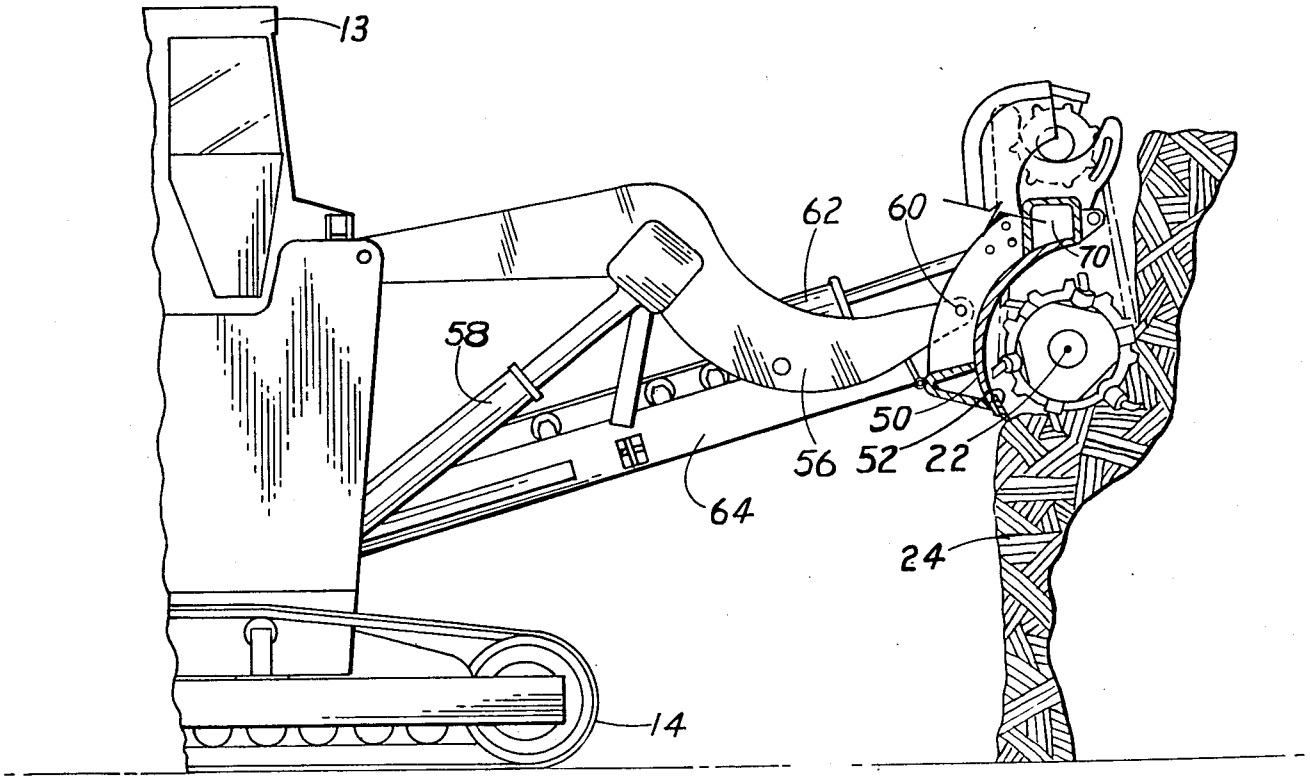
FIG. 4 is a fragmentary side view of the fore end of the excavating apparatus of FIG. 1 showing an additional operative mining position.

After the up-cut is completed, and the cutter positioned as shown in position C, a down-cut can be made. To begin a down-cut from position C, cutting head 20 is pivoted forward until the assembly is nearly vertical. This causes transverse axis 22 and correspondingly cutting head 20 to be moved into the face, causing a cut to be made into the face as the pivoting occurs. With the cutting head 20 in a generally vertical position, boom arms 56 are swung downward with the outer shoe edge 54 maintaining contact with the face, as illustrated in FIG. 4. An up-cut can then be conducted at the completion of the down-cutting stroke, as previously described. Such is an example of one method of cutting a face of material using an apparatus in accordance with the invention.

Figure 5:
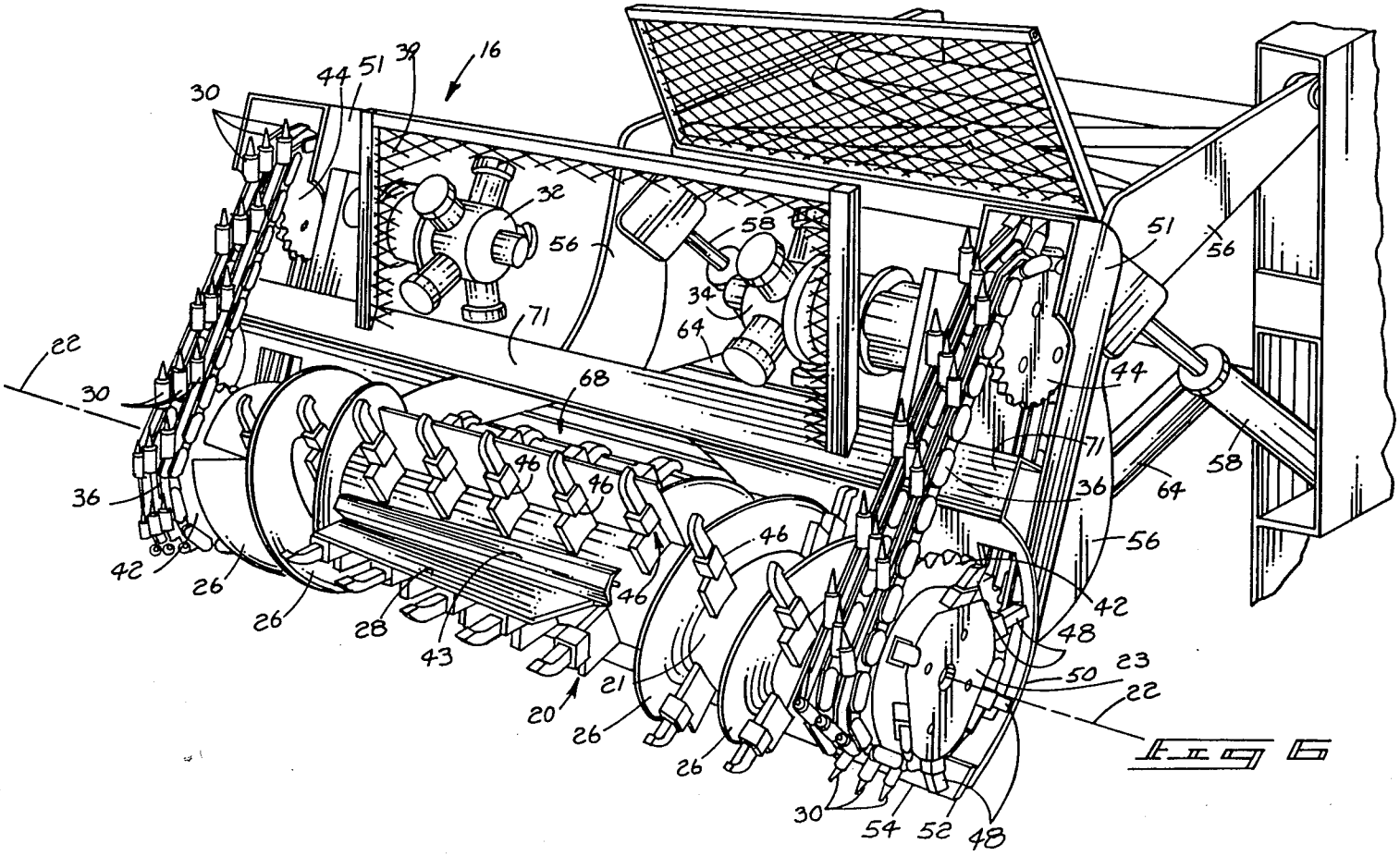
FIG. 5 is a fragmentary side view of the fore end of the excavating apparatus of FIG. 1 shown performing a thin seam cut.

FIG. 5 illustrates how the apparatus can be employed for thin seam cutting within an open pit mine. As shown, cutting head assembly 16 is pivoted slightly forwardly and the apparatus advanced to produce a desired thin seam cutting affect.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An excavating apparatus for breaking and removing material away from an upright face of material, the apparatus comprising:

a rotary cutting head adapted for rotation about a longitudinal axis, the cutting head having peripheral cutter elements that are located between first and second cutting head ends and define a cutting head diameter, the cutting head diameter being substantially less than the height of the upright face of material to be excavated;

power drive means for rotating the cutting head about its axis;

a shoe having an outer longitudinal edge extending across the length of the longitudinal cutting head at a location adjacent its peripheral cutter elements and elevationally below its longitudinal axis;

adjustment means for elevationally moving the shoe and rotary cutting head in unison relative to the upright face as the cutting wheel removes material from the upright face; and positioning means for moving the shoe primarily transversely relative to the cutting head axis and toward or away from the upright face of material to be excavated independent of elevational movement of the shoe and rotary cutting head by the adjustment means for selectively bringing the outer longitudinal edge of the shoe into sealing engaging relationship with the upright face;

whereby material removed from an upright face by the cutting wheel is generally collected from a location from where it was removed and substantially prevented from falling below the shoe which would generate excessive amounts of dust.

2. The excavating apparatus of claim 1 wherein the peripheral cutter elements are adjustable radially relative to the rotary cutting head.

3. The excavating apparatus of claim 1 wherein the adjustment means comprises; pivotal boom arms; the shoe and the rotary cutting head being operably connected to the boom arms at outer ends of the boom arms.

4. The excavating apparatus of claim 1 wherein, the outer longitudinal edge of the shoe is movable from a position behind the longitudinal cutting head axis to a position forward of the longitudinal cutting head axis and toward or away from the upright face of material to be excavated.

5. The excavating apparatus of claim 1 further comprising receiving means for confining and directing material broken by the cutting head away from the cutting head.

6. The excavating apparatus of claim 5 wherein the receiving means comprises a shroud partially surrounding the cutting head and extending longitudinally between the first and second cutting head ends.

7. The excavating apparatus of claim 6 wherein the receiving means comprises conveyor means in communication with the shroud for transferring material broken by the cutting head away from the cutting head, the shroud being positioned adjacent the conveyor means for collecting and transferring material broken by the cutting head to the conveyor means.

8. The excavating apparatus of claim 7 wherein the peripheral cutter elements are arranged in a spiral configuration to move material broken by the cutting head towards the center of the cutting head; and the shroud having a centrally disposed aperture for transferring broken material therethrough to the conveyor means.

9. The excavating apparatus of claim 6 wherein the shoe is positioned along one longitudinal edge of the shroud.

10. The excavating apparatus of claim 6 wherein the shoe and shroud are connected to one another, the shoe being connected along one longitudinal edge of the shroud.

11. The excavating apparatus of claim 6 wherein, the shoe is connected to the shroud;

the shroud is operably connected with the rotary cutting head whereby movement of the shroud causes movement of the cutting head axis; and the positioning means comprises pivotal connection means mounting the shroud to the adjustment means for enabling pivotal movement of the shroud and cutting head relative to the adjustment means about a pivot axis, the pivotal connection means including means for selectively varying the relative pivotal position of the shroud and adjustment means for locating the outer longitudinal edge of the shoe against the upright face.

12. The excavating apparatus of claim 11 wherein the pivot axis and cutting head axis are parallel.

13. The excavating apparatus of claim 1 further comprising a breaker bar extending along the cutting head and positioned away from the cutting head at a predetermined radial distance relative to the cutting head axis for causing material cut by the cutter elements to be of a predetermined size.

14. The excavating apparatus of claim 13 further comprising means for selectively varying the predetermined radial distance for enabling the predetermined size to be varied.

15. The excavating apparatus of claim 14 wherein the peripheral cutter elements are adjustable radially relative to the rotary cutting head.

16. A rotary cutting head assembly for mounting to a vertically movable boom of an excavating vehicle, the rotary cutting head assembly being adapted for breaking and removing material away from an upright face of material, the rotary cutting head assembly comprising:

a rotary cutting head mounted for rotation about a longitudinal axis, the cutting head having peripheral cutter elements that are located between first and second cutting head ends and define a cutting head diameter, the cutting head diameter being substantially less than the height of the upright face of material to be excavated;

power drive means for rotating the cutting head about its axis;

a shroud elevationally movable with the cutting head and partially surrounding the cutting head, the shroud extending between the first and second cutting head ends for confining material broken by the cutting head, the shroud including a longitudinally extending shoe portion having an outer longitudinal edge extending along the length of the cutting head at a location adjacent its peripheral cutter elements and elevationally below its longitudinal axis, the shoe being adapted for engaging and sealing the upright face with respect to the cutting head; and pivotal connection means for mounting the shroud to the elevationally movable boom for enabling pivotal movement of the shroud and cutting head relative to the boom about a pivot axis, the pivotal connection means including means for selectively varying the relative pivotal position of the shroud and boom for locating the edge shoe portion against the face.

17. The rotary cutting head assembly of claim 16 wherein the pivot axis and cutting head axis are parallel.

18. The rotary cutting head assembly of claim 16 wherein, the outer longitudinal edge of the shoe is movable from a position behind the longitudinal cutting head axis to a position forward of the longitudinal cutting head axis and toward or away from the upright face of material to be excavated.

19. The rotary cutting head assembly of claim 16 wherein the shroud and edge shoe portion are distinct yet connected members.

20. The rotary cutting head assembly of claim 16 further comprising a breaker bar extending along the cutting head and positioned away from the cutting head at a predetermined radial distance relative to the cutting head axis for causing material cut by the cutter elements to be of a predetermined size.

21. The rotary cutting head assembly of claim 20 further comprising means for selectively varying the predetermined radial distance for enabling the predetermined size to be varied.

22. An excavating apparatus for breaking and removing material away from an upright face of material, the apparatus comprising:

a vehicle;

means supporting the vehicle for movement over a surface generally transverse to the upright face;

a boom member mounted to the vehicle for elevational movement relative to the surface;

a rotary cutting apparatus mounted to the boom member, the rotary cutting apparatus comprising:

(a) a rotary cutting head mounted for rotation about a longitudinal axis, the cutting head having peripheral cutter elements that are located between first and second cutting head ends and define a cutting head diameter, the cutting head diameter being substantially less than the height of the upright face of material to be excavated;

(b) power drive means for rotating the cutting head about its axis;

(c) a shroud elevationally movable with the cutting head and partially surrounding the cutting head, the shroud extending between the first and second cutting head ends for confining material broken by the cutting head, the shroud including a longitudinally extending shoe portion having an outer longitudinal edge extending along the length of the cutting head at a location adjacent its peripheral cutter elements and elevationally below its longitudinal axis, the shoe being adapted for engaging and sealing the upright face with respect to the cutting head;

(d) pivotal connection means mounting the shroud to the boom member for enabling pivotal movement of the shroud and cutting head relative to the boom member about a pivot axis, the pivotal connection means including means for selectively varying the pivotal position of the shroud relative to the boom member for locating the outer longitudinal edge of the shoe portion against the upright face; and conveyor means in communication with the shroud for transferring material broken by the cutting head away from the excavating apparatus.

23. The excavating apparatus of claim 22 wherein, the outer longitudinal edge of the shoe is movable from a position behind the longitudinal cutting head axis to a position forward of the longitudinal cutting head axis and toward or away from the upright face of material to be excavated.

* * * * *